United States Patent [19]

Rote

[11] Patent Number: 4,749,095

[45] Date of Patent: Jun. 7, 1988

[54] TAMPER-INDICATING CLOSURE AND PACKAGE

[75] Inventor: Bruce J. Rote, Sturgis, Mich.

[73] Assignee: Owens-Illinois Closure Inc., Toledo, Ohio

[21] Appl. No.: 54,978

[22] Filed: May 28, 1987

[51] Int. Cl.[4] ..... B65D 41/34

[52] U.S. Cl. ..... 215/252; 215/258

[58] Field of Search ..... 215/252, 258, 253, 256

[56] References Cited

U.S. PATENT DOCUMENTS

| | | | |
|---|---|---|---|
| 3,874,540 | 4/1975 | Hidding | 215/252 |
| 4,196,818 | 4/1980 | Brownbill | 215/252 |
| 4,322,012 | 3/1982 | Conti | 215/252 |
| 4,448,318 | 5/1984 | Lowe | 215/252 |
| 4,458,821 | 7/1984 | Ostrowsky | 215/252 |
| 4,625,875 | 12/1986 | Carr et al. | 215/252 |
| 4,635,808 | 1/1987 | Nolan | 215/252 |

*Primary Examiner*—George E. Lowrance
*Assistant Examiner*—Nova Stucker

[57] ABSTRACT

A tamper-indicating closure and package comprising a one-piece molded closure of plastic which threads onto a container such that when the closure is unthreaded, a tamper-indicating band becomes separated from the lower end of the closure skirt. The tamper-indicating band is joined to the closure along the weakened frangible line. Circumferentially extending relatively rigid locking members are supported on the inner surface of the closure by generally vertically extending flexible membranes such that when the closure is threaded onto the container, the locking members move radially outwardly as they engage an annular bead on the finish of the container causing the membranes to flex over the bead and bringing the locking members into engagement with the underside of the bead. When the closure is unthreaded from the container, the engagement of the locking members with the underside of the head causes the membranes to be severed. In one form of closure, the membranes are inclined circumferentially opposite to the direction of rotation of the closure during threading to facilitate the flexing of the membranes.

12 Claims, 5 Drawing Sheets

TAMPER-INDICATING CLOSURE AND PACKAGE

This invention relates to tamper-indicating closures and packages.

BACKGROUND AND SUMMARY OF THE INVENTION

It has heretofore been suggested that a tamper-indicating band be connected to a closure, the band having flexible portions that are deflected over an annular bead on the container and under the annular bead such that when the closure is unthreaded from the container, the flexible portions cause the band to be severed from the remainder of the closure indicating that the closure has been opened.

In U.S. Pat. Nos. 4,350,844 and 4,613,052, having a common assignee with the present application, there is disclosed and claimed a screw type cap of plastic with a tamper-indicating ring or band that is carried at the lower end of the skirt of the closure with frangible bridges forming the connection. The removal of the closure results in the indicating lower position on the neck and is presented from being returned to its, as applied, position. A container has a finish, below external threads which is formed with an inwardly and downwardly tapering side wall which leads to an abrupt, horizontal ledge such that when an indicating band is severed from a closure, on removal, the band falls below the ledge and cannot be returned. The closure is formed with internal threads in the skirt and at the bottom of the skirt a band or ring of about the same external diameter as the cap is formed with frangible bridges joining the band to the skirt. Within the indicating band, an inwardly extending flexible stop ring is formed integral with the indicating band. A particular finish on the container provides a pair of radial ledges which extend outwardly below the threads on the container neck. These ledges are vertically displaced relative to each other and are joined by an inwardly tapering wall which is adapted to form the surface on which the stop ring will be seated when the closure is applied. The stop ring prevents removal of the closure without the separation of the indicating band from the closure skirt.

In U.S. patent application Ser. No. 820,034, filed Jan. 21, 1986, having a common assignee with the present application, there is disclosed a tamper-indicating package comprising a container having a neck with a threaded finish and a closure which includes a base wall and depending peripheral skirt having threads interengaging the threads of the container, and a tamper-indicating band attached to the skirt by a plurality of circumferentially spaced frangible bridge members. The tamper-indicating band includes a bead for engaging a complementary bead on the container, and a segmented annular flange extending axially upwardly and inwardly from the lower edge of the tamper-indicating band towards the base wall of the closure. The annular flange has its free edge formed with a plurality of segments such that the stiffness of the flange is reduced. In addition, the leading end of each segment is cut to a 30° angle. These two features facilitate the application of the closure to the container.

In U.S. Pat. No. 4,546,892, there is disclosed a plastic tamper-indicating closure which has an annular wall extending upwardly and inwardly and an annular bead or heel along the inner surface of the wall so that when the closure is applied to a container, the annular wall is interposed between the skirt of the closure and the finish of the container and the bead engages the underside of the ring on the finish to hold the closure in position.

In tamper-indicating packages which utilize closures that have flexible portions associated with the tamper-indicating band, when such closures are utilized with glass containers that have a wide range of tolerances, it is sometimes difficult to insure that proper clearance will be provided. In addition, because of the flexibility of the portions, there may be concern that somehow a user might attempt to deflect the portions in order to remove the closure and thereby defeat the purpose.

In the molding of such closures, it is often necessary to use complex molds and, in addition, post molding operations such as reforming in order to make the closure function.

Accordingly, among the objectives of the present invention are to provide tamper-indicating closure and package which will provide a tamper evident feature which is more reliable over a wider range of finish tolerances and which is much more difficult to defeat than certain plastic closures that have plural flexible portions that engage the container and which requires simpler tooling; which does not require post molding operations; wherein the torque required to apply the closure is reduced; and which will accommodate a wide range of tolerances.

In accordance with the invention, a tamper-indicating closure and package comprising a one-piece molded closure of plastic and a container having interengaging means such that when the closure is removed, a tamper-indicating ring becomes separated from the lower end of the closure skirt. The tamper-indicating band is joined to the closure along the weakened frangible line. Circumferentially extending relatively rigid locking members are supported on the inner surface of the closure by generally vertically extending flexible membranes such that when the closure is threaded onto the container, the locking members move radially outwardly as they engage an annular bead on the finish of the container causing the membranes to flex over the bead and bringing the locking members into engagement with the underside of the bead. When the closure is removed from the container, the engagement of the locking members with the underside of the bead causes the membranes to be severed. in one form of closure, the membranes are inclined circumferentially opposite to the direction of rotation of the closure during threading to facilitate the flexing of the membranes.

DESCRIPTION

Figure 1:
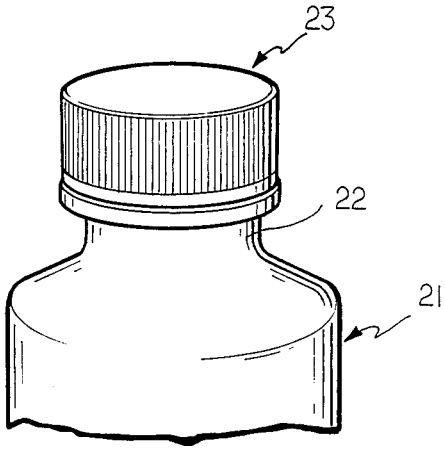
FIG. 1 is a fragmentary perspective view of a tamper-indicating package embodying the invention.
Figure 3:
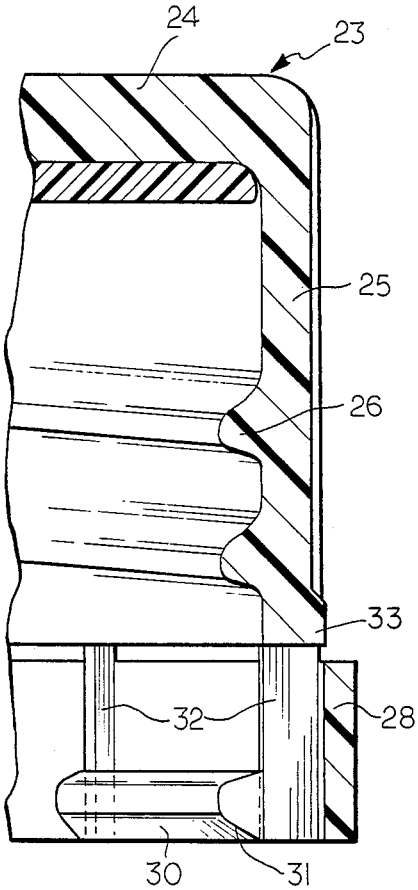
FIG. 3 is a fragmentary vertical sectional view on an enlarged scale taken along the line 3—3 in FIG. 2.

Referring to FIG. 1, the tamper-indicating package embodying the invention comprises a container such as a glass or plastic container 21 having a finish or neck 22. A closure 23 is formed of a thermoplastic material, such as polypropylene, molded as a single unit and comprising a generally flat disk-shaped base 24 and cylindrical depending skirt 25. The inner surface of the skirt 25 is formed with threads 26 which are adapted to engage complementary threads 27 on finish 22. An integral tamper-indicating band 28 extends downwardly from the skirt 25 and has a slightly greater diameter than the skirt 25 and projects radially beyond the skirt 25. Circumferentially spaced relatively rigid locking members 30 in the form of beads having a lower inwardly inclined surface 31 are supported at circumferentially spaced points be vertical membranes 32 that are attached preferably at the ends of each locking member 30 and extend upwardly and are joined to the lower end 33 of the skirt 25. In this manner, the locking members 30 are flexibly connected to the skirt.

In the form shown in FIGS. 2–7, the membranes 32 are generally planar and are inclined rearwardly from the member 30 in a direction opposite the direction of rotation of the closure when threading onto the container. The membranes 32 have a greater dimension radially and axially as contrasted to their thickness. In addition, the membranes 32 are attached to the inner surface of band 28 along the entire axial dimension of the band 28. The membranes have a radial width substantially equal to the thickness of skirt 25 and substantially aligned with the skirt 25. As shown in FIG. 8, the radius of the segments 30 is substantially equal to the radius of the bead 35 of the container. The lower edge of the skirt 25 is spaced from the band 28 and the membranes 32 bridge this space such that the stresses placed on the membranes 32 during removal of the closure will be concentrated in the portions of the membranes 32 adjacent the lower end of the skirt 25, thereby causing the membranes to break in those portions.

Figure 4:
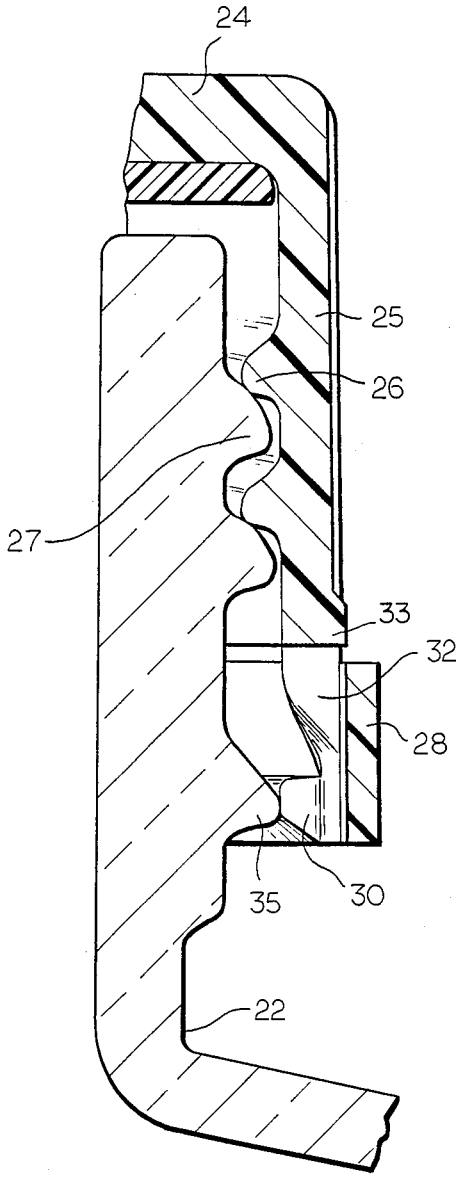
FIG. 4 is a fragmentary vertical sectional view taken along the line 4—4 in FIG. 8 showing the closure being applied to the container.
Figure 5:
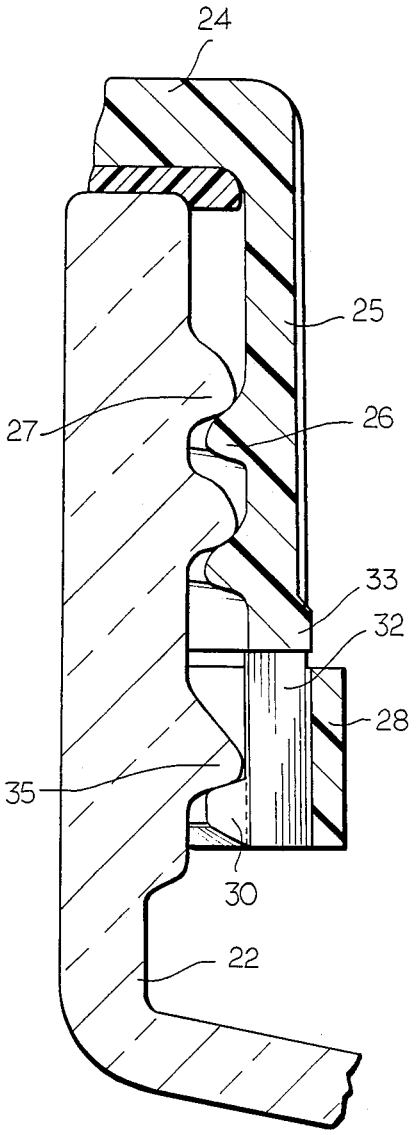
FIG. 5 is a fragmentary vertical sectional view taken along the line 5—5 of FIG. 9 showing the closure after it has been applied to the container.
Figure 8:
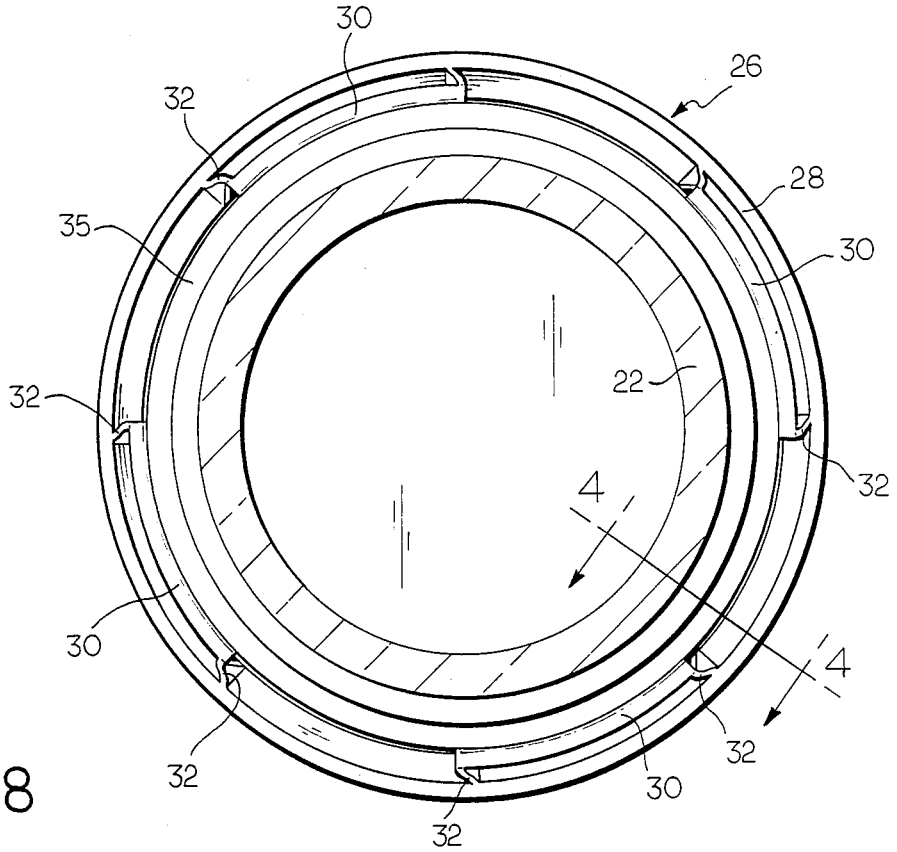
FIG. 8 is a part sectional bottom plan view of the closure being applied to the container.
Figure 9:
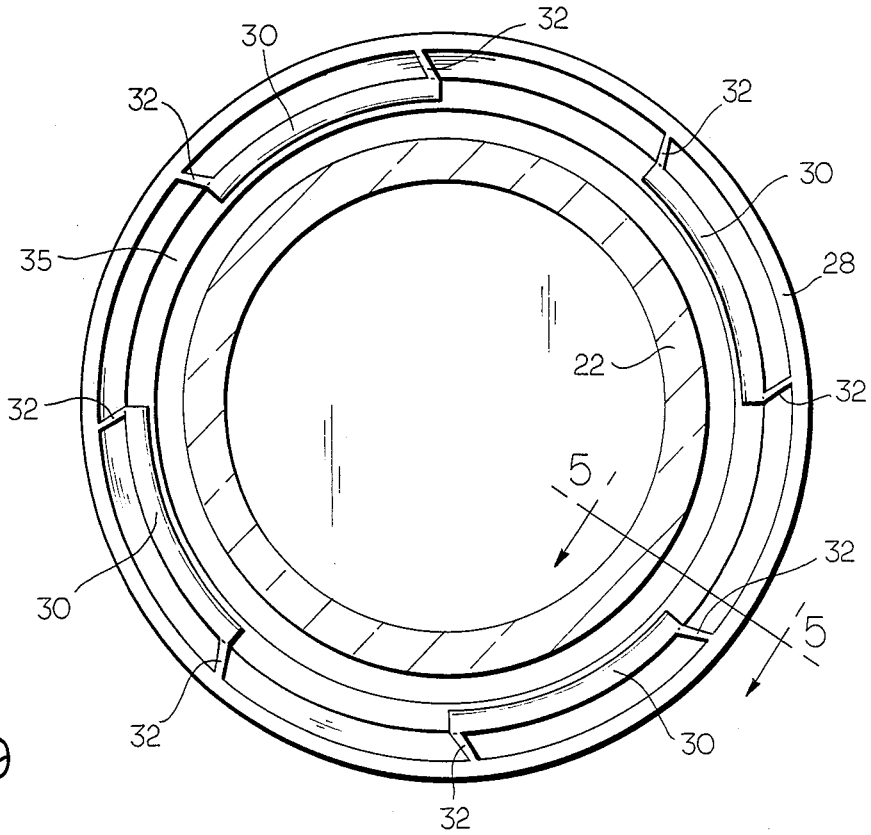
FIG. 9 is a part sectional bottom plan view of the closure after it has been applied to the container.

Referring to FIG. 4, as the closure is threaded on the container, the locking members 30 move radially outwardly due to the flexing of the membranes 32 caused by engagement of the members 30 with the bead 35 on the finish 22 of the container. The flexing is facilitated by the inclination of the membranes and their ability to flex in a twisting or torsion-like fashion as seen in FIGS. 4 and 8. As the closure is further threaded on the container, the locking members 30 pass over the bead 35 and engage the underside of the bead 35 as shown in FIGS. 5 and 9.

Figure 6:
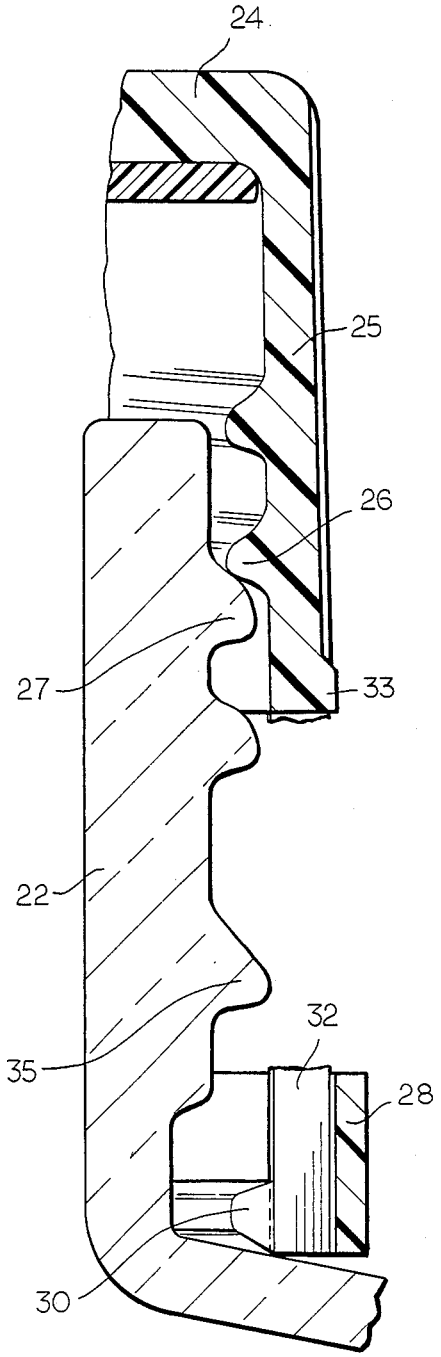
FIG. 6 is a fragmentary vertical sectional view showing the closure being removed from the container.
Figure 7:
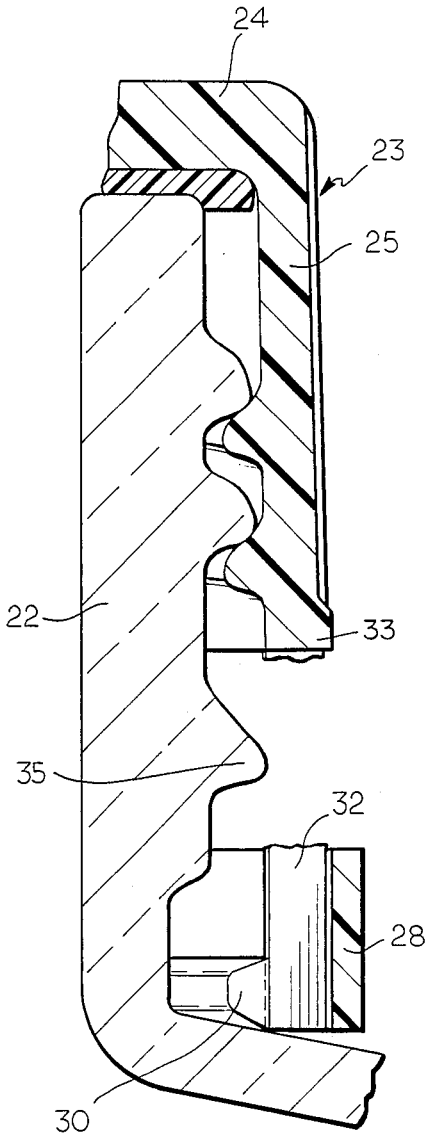
FIG. 7 is a fragmentary sectional view showing the closure being re-applied to the container.

Referring to FIGS. 6 and 7, when the closure is unthreaded, the engagement of the locking members 30 with the bead 35 causes the membranes to be severed at the juncture of the membranes with the lower edge of the skirt so that the band then falls downwardly. When the closure is re-applied, the lower edge of the skirt is spaced substantially from the band so that it can be readily indicated that the closure has been removed and re-applied.

Figure 11:
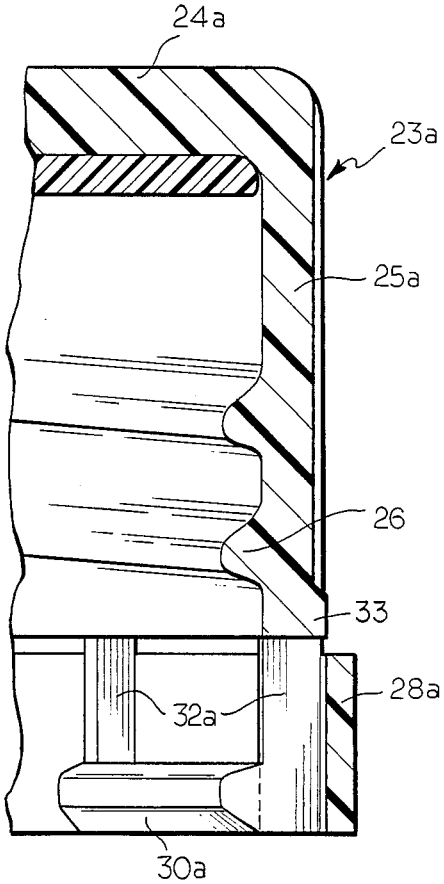
FIG. 11 is a fragmentary sectional view of the closure taken along the line 11—11 in FIG. 10.
Figure 2:
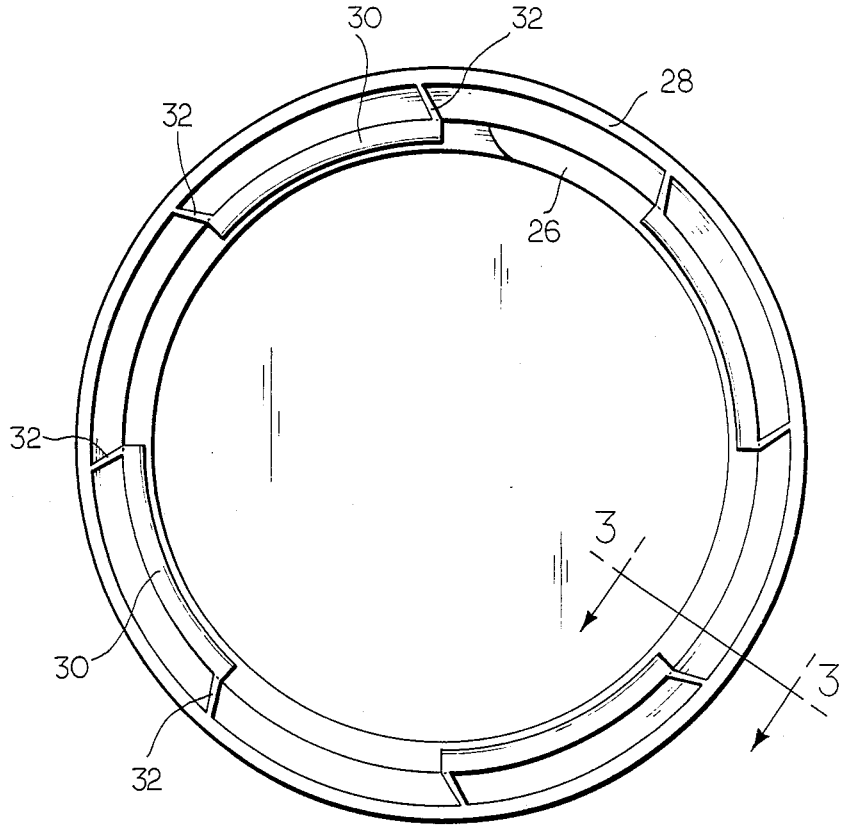
FIG. 2 is a bottom plan view of the closure.
Figure 10:
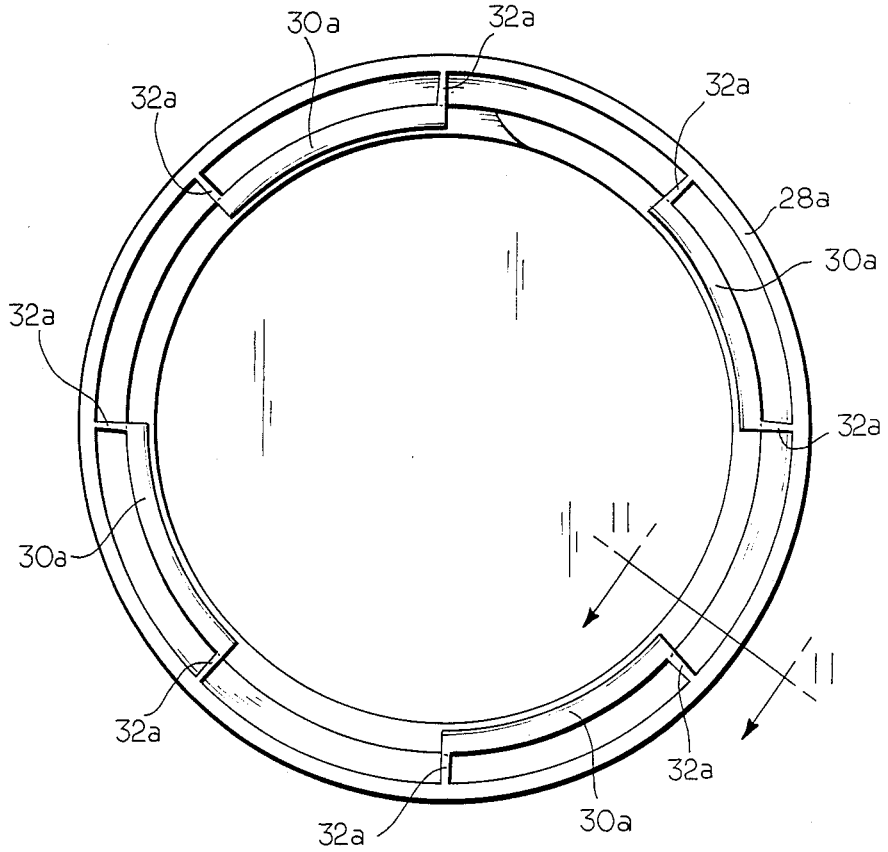
FIG. 10 is a bottom plan view of a modified form of closure.

In the form shown in FIGS. 10 and 11, the locking members 30*a* are attached to the skirt 25*a* and band 28*a* by membranes which extend radially.

It can thus be seen that the tamper-indicating closure and package provides a tamper evident feature which is more reliable over a wider range of finish tolerances; which is much more difficult to defeat than certain plastic closures that have plural flexible portions that engage the container; which requires simpler tooling; which does not require post molding operations; wherein the torque required to apply the closure is reduced; and which will accommodate a wide range of tolerances. Where the interengaging means between the closure and the container comprises threads, the construction permits the closure to be made by utilizing simple molds that do not require cam actuated components.

I claim:

1. A tamper-indicating closure comprising a one-piece molded closure of plastic having a base wall and peripheral skirt, said skirt having internal means adapted to engage means on a container upon relative rotation of the closure and container, a tamper-indicating band, circumferentially extending and circumferentially spaced relative rigid locking members, generally vertically extending generally radial flexible membranes joining the skirt of the closure, the locking members and the band, each said membrane having an upper end extending from adjacent the free edge of said skirt of said closure and having a radially outer edge connected to said band, each said membrane having a lower end with a radially inner edge connected to a locking member, a pair of membranes being provided for each locking member, said membranes being inclined at an acute angle to a radial plane in a direction circumferentially opposite to the direction of rotation of the closure during application of the closure such that when the closure is applied onto a container, the lower ends of said membranes flex relative to the upper ends adjacent the skirt and the locking members move radially outwardly as they engage an annular bead on the finish of the container causing the locking members to move over the bead and thereafter move radially inwardly into engagement with the underside of the bead, and when the closure is removed from a container, the engagement of the locking members with the underside of the bead causes the membranes to be severed.

2. The closure set forth in claim 1 wherein said membranes have a greater radial width than circumferential thickness and have a greater axial dimension than the circumferential thickness.

3. The closure set forth in claim 2 wherein said membranes are attached to said band along substantially the entire axial width of said band.

4. The closure set forth in claim 3 wherein the band is spaced axially from the lower end of the skirt.

5. The closure set forth in claim 4 wherein the locking members are arcuate in a circumferential direction.

6. The closure set forth in claim 5 wherein said membranes are generally uniformly thick.

7. A tamper indicating package comprising a one-piece molded closure of plastic, a container, an annular bead on the container, said closure and container having interengaging means operable upon relative rotation of the closure and container, a tamper indicating band, circumferentially extending and circumferentially spaced relatively rigid locking members, generally vertically extending flexible membranes joining said skirt of the closure, the locking members and said band, each said membrane having an upper and extending from adjacent the free edge of said skirt of said closure and having a radially outer edge connected to said band, each said membrane having a lower end with a radially inner edge connected to a locking member, a pair of membranes being provided for each locking member, said membranes being inclined at an acute angle to a radial plane in a direction circumferentially opposite to the direction of rotation of the closure during application of the closure such that when the closure is applied to the container, the lower ends of said membranes flex relative to the upper ends adjacent the skirt and the locking members move radially outwardly as they engage an annular bead on the finish of the container causing the locking members to move over the bead and thereafter move radially inwardly into engagement with the underside of the bead, and when the closure is removed from the container, the engagement of the locking members with the underside of the bead causes the membranes to be severed.

8. The package set forth in claim 7 wherein said membranes have a greater radial width than circumferential thickness and have a greater axial dimension than the circumferential thickness.

9. The package set forth in claim 8 wherein said membranes are attached to said band along substantially the entire axial width of said band.

10. The package set forth in claim 9 wherein the band is spaced axially from the lower end of the skirt.

11. The package set forth in claim 10 wherein the locking members are arcuate in a circumferential direction.

12. The package set forth in claim 11 wherein said membranes are generally uniformly thick.

* * * * *